US011367935B2

(12) United States Patent
Ravanelli et al.

(10) Patent No.: US 11,367,935 B2
(45) Date of Patent: Jun. 21, 2022

(54) MICROWAVE CIRCULAR POLARIZER

(71) Applicant: Thales Alenia Space Italia S.p.A. Con Unico Socio, Rome (IT)

(72) Inventors: Rodolfo Ravanelli, Rome (IT); Paolo Campana, Rome (IT)

(73) Assignee: Thales Alenia Space Italia S.p.A. Con Unico Socio, Rome (IT)

( * ) Notice: Subject to any disclaimer, the term of this patent is extended or adjusted under 35 U.S.C. 154(b) by 407 days.

(21) Appl. No.: 16/619,026

(22) PCT Filed: Jun. 7, 2018

(86) PCT No.: PCT/IB2018/054122
§ 371 (c)(1),
(2) Date: Dec. 3, 2019

(87) PCT Pub. No.: WO2018/225008
PCT Pub. Date: Dec. 13, 2018

(65) Prior Publication Data

US 2020/0136220 A1 Apr. 30, 2020

(30) Foreign Application Priority Data

Jun. 7, 2017 (IT) ..... 102017000062455

(51) Int. Cl.
*H01P 1/17* (2006.01)
*H01P 5/02* (2006.01)
(Continued)

(52) U.S. Cl.
CPC ..... *H01P 1/173* (2013.01); *H01P 5/024* (2013.01)

(58) Field of Classification Search
CPC ..... H01P 1/10; H01P 1/06; H01P 3/12; H01P 1/173; H01P 5/024; H01P 1/222
See application file for complete search history.

(56) References Cited

U.S. PATENT DOCUMENTS 6,323,819 B1 11/2001 Ergene
7,642,982 B2 1/2010 Cook
(Continued)

OTHER PUBLICATIONS

Chang et al., Theory and Experiment of a Compact Wave-Guide Dual Circular Polarizer, Progress in Electromagnetics Research, vol. 131, 211-225, 2012.

(Continued)

*Primary Examiner* — Wei (Victor) Y Chan
(74) *Attorney, Agent, or Firm* — McCarter & English, LLP

(57) ABSTRACT

The invention relates to a microwave circular polarizer including: a first outer conductor; a second outer conductor connected to the first outer conductor forming a first step discontinuity therewith; and a third outer conductor connected to the second outer conductor forming a second step discontinuity therewith. An inner conductor is provided which extends inside and is spaced apart from the first, second and third outer conductors. The first and second outer conductors are axially asymmetric with respect to the inner conductor, and the third outer conductor is axially symmetric with respect to the inner conductor. The microwave circular polarizer includes first and second rectangular waveguide ports in signal communication with an internal cavity through, respectively, a first rectangular aperture and a second rectangular aperture formed through the first outer conductor. The microwave circular polarizer further includes a first septum and a second septum.

11 Claims, 6 Drawing Sheets

(51) Int. Cl.

| | |
|---|---|
| ***H01P 1/10*** | (2006.01) |
| ***H01P 1/06*** | (2006.01) |
| ***H01P 3/12*** | (2006.01) |

(56) References Cited

U.S. PATENT DOCUMENTS

| | | | | |
|---|---|---|---|---|
| 8,354,969 | B2 | 1/2013 | Lin et al. | |
| 9,142,893 | B2 | 9/2015 | Son et al. | |
| 2007/0296641 | A1 | 12/2007 | Cook | |
| 2013/0307721 | A1 | 11/2013 | Son et al. | |
| 2021/0320415 | A1* | 10/2021 | Calzuola | H01P 3/12 |

OTHER PUBLICATIONS

Jung, Y.B., Ka-band polariser structure and its antenna application, Electronics Letters, vol. 45, No. 18, Aug. 27, 2009.

Piovana et al., CAD and Optimization of Compact Wide-band Septum Polarizers, 29th European Microwave Conference, Munich, 1999.

Virone et al., A Novel Design Tool for Waveguide Polarizers, IEEE Transactions on Microwave Theory and Techniques, vol. 53, No. 3, Mar. 2005.

Zhang, Tian-ling et al., A Ka Dual-Band Circular Waveguide Polarizer, 7th International Symposium on Antennas, Propagation & EM Theory, 2006.

PCT International Search Report and Written Opinion for PCT/IB2018/054122 dated Sep. 27, 2018.

* cited by examiner

| | |
|---|---|
| Type | E-Field (peak) |
| Monitor | e-field (f=8.25) [2(1)] |
| Plane at z | 52.4859 |
| Maximum-2D | 1797.85 V/m at -1.01333 / 2.08 / 52.4859 |
| Frequency | 8.25 |

| | |
|---|---|
| Type | E-Field (peak) |
| Monitor | e-field (f=8.25) [2(1)] |
| Plane at z | 52.4859 |
| Maximum-2D | 1797.85 V/m at -1.01333 / 2.08 / 52.4859 |
| Frequency | 8.25 |

MICROWAVE CIRCULAR POLARIZER

CROSS-REFERENCE TO RELATED APPLICATIONS

This application is a 35 U.S.C. § 371 National Stage filing of International Application No. PCT/IB2018/054122, filed on Jun. 7, 2018, which claims priority to Italian Patent Application 102017000062455, filed on Jun. 7, 2017.

TECHNICAL FIELD OF THE INVENTION

The present invention concerns a microwave circular polarizer, namely a device for converting linearly polarized microwave signals into circularly polarized microwave signals and vice versa.

STATE OF THE ART

The prior art teaches a variety of ways to convert linearly polarized microwave signals into circularly polarized microwave signals and vice versa. For example, the transformation between a linear polarization and a circular polarization (in particular, right-hand circular polarization (RHCP) and/or left-hand circular polarization (LHCP)) can be accomplished by means of:

- a stepped septum (in this connection, reference can be made, for example, to Uher J., Bornemann J., Rosenberg U., "*Waveguide Components for Antenna Feed Systems: Theory and CAD*", Artech House, 1993, and to Piovano B., Bertin G., Accatino L., "*CAD and Optimization of Compact Wide-band Septum Polarizers*", 29th European Microwave Conference, 5-7 Oct. 1999, Munich, Germany);
- stepped corrugations (in this connection, reference can be made, for example, to Jung Y. B., "*Ka-band polariser structure and its antenna application*", Electronics Letters Vol. 45, Issue 18, pages 931-932, 2009, and to Virone G., Tascone R., Baralis M., "*A novel design tool for waveguide polarizers*", IEEE Transactions on Microwave Theory and Techniques, Vol. 53, Issue 3, pages 888-894, 2005);
- grooves (in this connection, reference can be made, for example, to Chang C., Church S., Tantawi S. G., Larkoski P. V., Sieth M., Devaraj K., "*Theory and experiment of a compact waveguide dual circular polarizer*", Progress In Electromagnetics Research, Vol. 131, pages 211-225, 2012); and
- loaded dielectrics (in this connection, reference can be made, for example, to Zhang T. L., Yan Z. H., "*A Ka Dual-Band Circular Waveguide Polarizer*", 7th International Symposium on Antennas, Propagation & EM Theory, 26-29 Oct. 2006, Guilin, China).

Some of these approaches require large encumbrance configurations employing two devices in cascade: an OrthoMode Transducer (OMT) to produce two linear orthogonal modes into a waveguide, and a phase shifter to achieve the necessary 90-degree differential phase between said linear orthogonal modes. The phase shifter can be made in different ways using grooves on opposite sides of a square waveguide, irises, or dielectrics.

A more compact device is represented by the so-called septum polarizer, which typically includes a square waveguide and a stepped metal septum, that is inserted into the square waveguide along the longitudinal axis thereof thereby dividing said square waveguide into two equal rectangular sections (in this connection, reference can be made, for example, to U.S. Pat. No. 8,354,969 B2). A circularly polarized wave received at the square waveguide port is converted into a pair of orthogonal modes ($TE_{10}$ and $TE_{01}$), one of which is orthogonal to the septum and the other parallel. These two modes are in quadrature to each other.

Further examples of known circular polarizers are provided in US 2007/296641 A1, U.S. Pat. No. 6,323,819 B1 and US 2013/307721 A1.

In particular, US 2007/296641 A1 discloses an antenna feed horn extending in a signal propagation direction, comprising:

- a reception end defined by an undivided, oblong input aperture;
- a first output port spaced apart from the input aperture in the signal propagation direction, a first phase adjustment structure extending from the input aperture to the first output port, a second output port spaced apart from the first output port in the signal propagation direction, and a second phase adjustment structure extending from the first output port to the second output port;
- a diplexer for directing a first signal propagating at a first desired frequency exhibiting circular polarity expressed by orthogonal linear components when incident at the input aperture the first output port, and for directing a second signal propagating at a second desired frequency exhibiting circular polarity expressed by orthogonal linear components when incident at the input aperture to a second output port;
- for the first signal propagating, the interior surface of the first phase adjustment structure configured to differentially phase shift the linear components by approximately 90 degrees to convert the signal from circular polarity to linearly polarity as the first signal propagates through the first phase adjustment structure from the input aperture to the first output port; and
- for the second signal, the interior surfaces of the first and second phase adjustment structures configured to differentially phase shift the linear components by approximately 90 degrees to convert the second signal from circular polarity to linearly polarity as the second signal propagates through the first and second phase adjustment structure from the input aperture to the second output port.

Instead, U.S. Pat. No. 6,323,819 B1 discloses a dual band multimode coaxial antenna feed having an inner section of longitudinal hollow waveguide having first and second orthogonal mode transducers that interface first and second orthogonally polarized cylindrical waveguide $TE_{11}$ mode signals lying in a first upper (e.g., Ka) frequency band. An outer coaxial waveguide section has a Potter horn surrounding the inner waveguide section, which terminates at a polyrod. The outer section includes third and fourth orthogonal mode transducers that interface orthogonally polarized coaxial waveguide $TE_{11}$ mode signals lying in a second lower (e.g., X) frequency band. A tracking port coupled to the outer coaxial waveguide section provides an output representative of the difference pattern of the radiation profile produced by transverse electromagnetic TEM mode signals generated and propagating in the outer coaxial waveguide. A mode suppressor in the outer waveguide section adjacent its two orthogonal mode transducers locally suppresses TEM signals in their vicinity. A broadband compensated polarizer is installed in the inner waveguide section operating in the high band, and a broadband coaxial compensated polarizer is installed in the outer coaxial waveguide section operating in the low band.

Finally, US 2013/307721 A1 discloses a polarizer rotating device and a satellite signal receiving apparatus having the same. The satellite signal receiving apparatus includes a feedhorn that receives a satellite signal; a low noise block down converter that processes the signal received by the feedhorn; a skew compensating device that is provided at the low noise block down converter or the feedhorn and rotates the low noise block down converter or the feedhorn to compensate for a skew angle when the satellite signal received by the feedhorn is a linearly polarized wave; a polarizer that receives a linearly polarized signal and a circularly polarized signal of the satellite signal; and a polarizer rotating device that rotates the polarizer when the satellite signal received by the polarizer is a circularly polarized wave.

The main technical drawbacks of the currently known circular polarizers are:

- a large axial envelope, in the order of 2-2.5λ for septum polarizers (where A denotes the wavelength of signals which a septum polarizer is designed for) and even larger for the other configurations; and
- said circular polarizers can be used only in circular feed radiofrequency (RF) chains and for single frequency bands.

OBJECT AND SUMMARY OF THE INVENTION

Object of the present invention is that of alleviating, at least in part, the aforesaid drawbacks of the known microwave circular polarizers.

This and other objects are achieved by the present invention in that it relates to a microwave circular polarizer, as defined in the appended claims.

In particular, the microwave circular polarizer according to the present includes:

- a first outer conductor, which is cylindrically shaped and internally hollow;
- a second outer conductor, which is cylindrically shaped, internally hollow, and is connected to the first outer conductor forming a first step discontinuity therewith; and
- a third outer conductor, which is cylindrically shaped, internally hollow, and is connected to the second outer conductor forming a second step discontinuity therewith.

In particular, a first longitudinal axis of the first outer conductor, a second longitudinal axis of the second outer conductor, and a third longitudinal axis of the third outer conductor are parallel to one another.

Moreover, said microwave circular polarizer further includes an inner conductor, which is cylindrically shaped, extends inside the first, second and third outer conductors, and is spaced apart from said first, second and third outer conductors, thereby resulting in an internal cavity being present between said inner conductor and said first, second and third outer conductors.

In particular, a fourth longitudinal axis of the inner conductor coincides with the third longitudinal axis and is parallel to the first and second longitudinal axes, thereby resulting in an axially asymmetrical configuration of the first and second outer conductors with respect to the inner conductor, and an axially symmetrical configuration of the third outer conductor with respect to said inner conductor.

Additionally, said microwave circular polarizer further includes a first rectangular waveguide port and a second rectangular waveguide port, that are:

- coupled to the first outer conductor externally to the internal cavity;
- oriented orthogonally to the first longitudinal axis;
- positioned relative to one another so as to form a 90-degree angle with respect to said first longitudinal axis; and
- in signal communication with the internal cavity through, respectively, a first rectangular aperture and a second rectangular aperture formed through the first outer conductor.

Finally, said microwave circular polarizer further includes a first septum and a second septum.

In particular, said first septum is arranged on the first outer conductor inside the internal cavity and is positioned, relative to the first and second rectangular waveguide ports, so as to form, with each of said first and second rectangular waveguide ports, a respective 45-degree angle with respect to the first longitudinal axis.

Furthermore, the second septum is arranged on the inner conductor inside the internal cavity and is positioned, relative to the first and second rectangular waveguide ports, so as to form, with each of said first and second rectangular waveguide ports, a respective 135-degree angle with respect to the first longitudinal axis.

BRIEF DESCRIPTION OF THE DRAWINGS

For a better understanding of the present invention, preferred embodiments, which are intended purely by way of non-limiting examples, will now be described with reference to the attached drawings (all not to scale), wherein.

DETAILED DESCRIPTION OF PREFERRED EMBODIMENTS OF THE INVENTION

The following discussion is presented to enable a person skilled in the art to make and use the invention. Various modifications to the embodiments will be readily apparent to those skilled in the art, without departing from the scope of the present invention as claimed. Thence, the present invention is not intended to be limited to the embodiments shown and described, but is to be accorded the widest scope consistent with the principles and features disclosed herein and defined in the appended claims.

Figure 1:
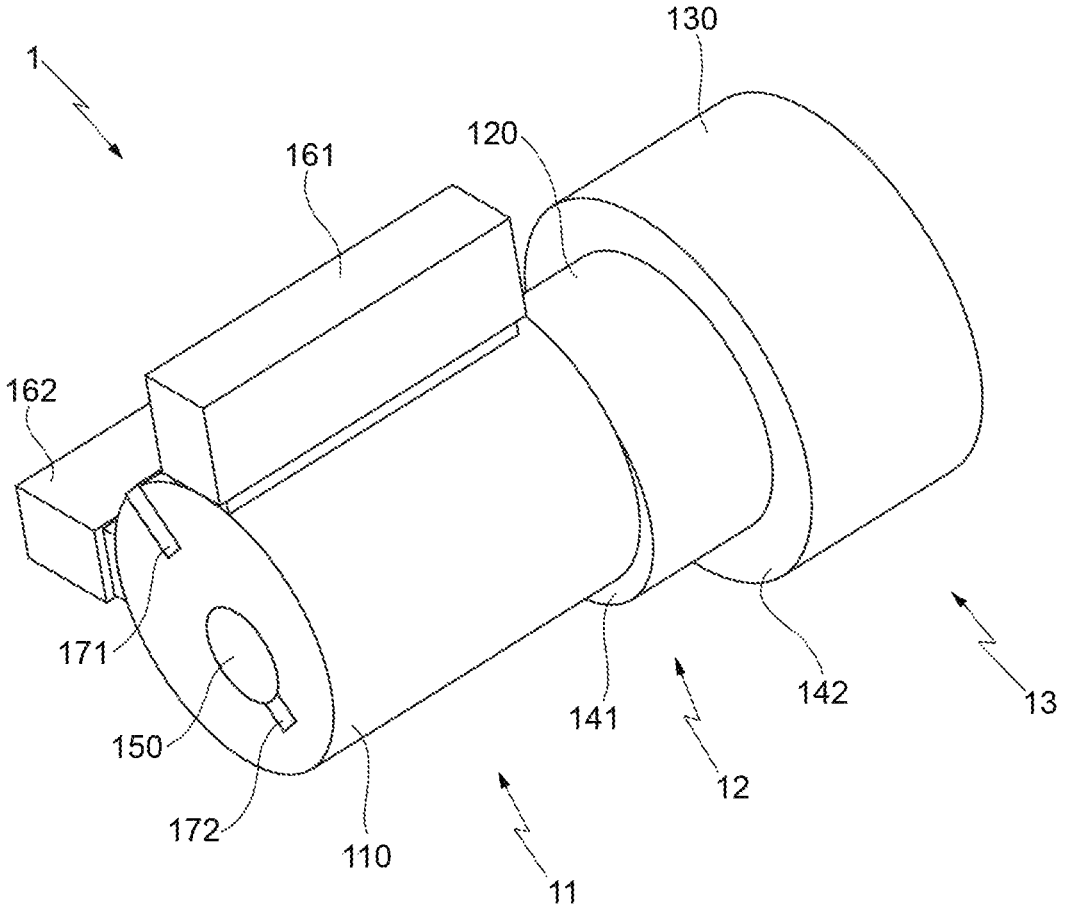
FIGS. 1-3 are, respectively, perspective, bottom and top views of a microwave circular polarizer according to a preferred embodiment of the present invention.
Figure 2:
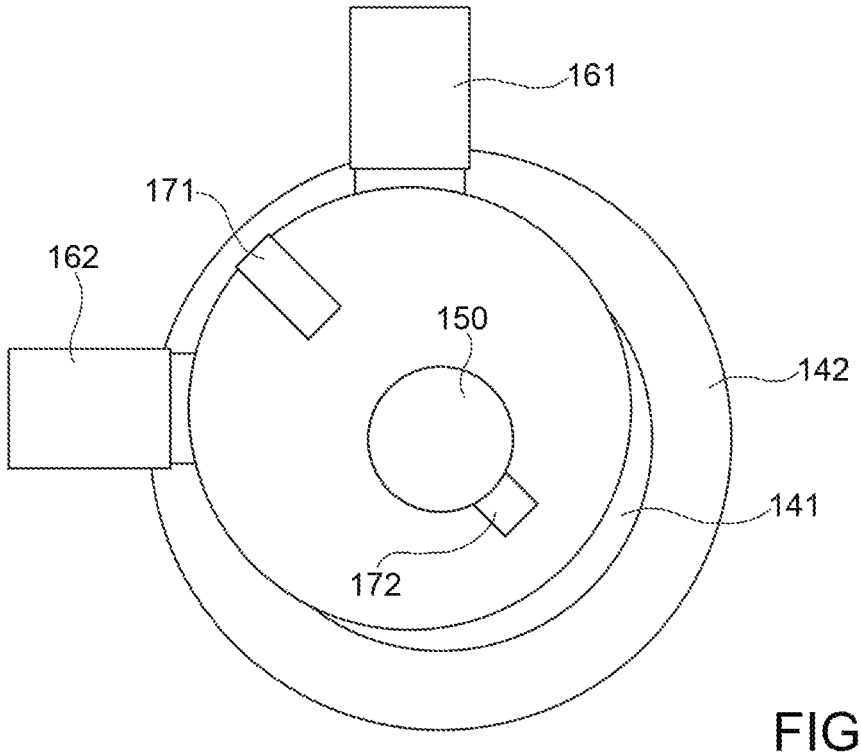
Figure 3:
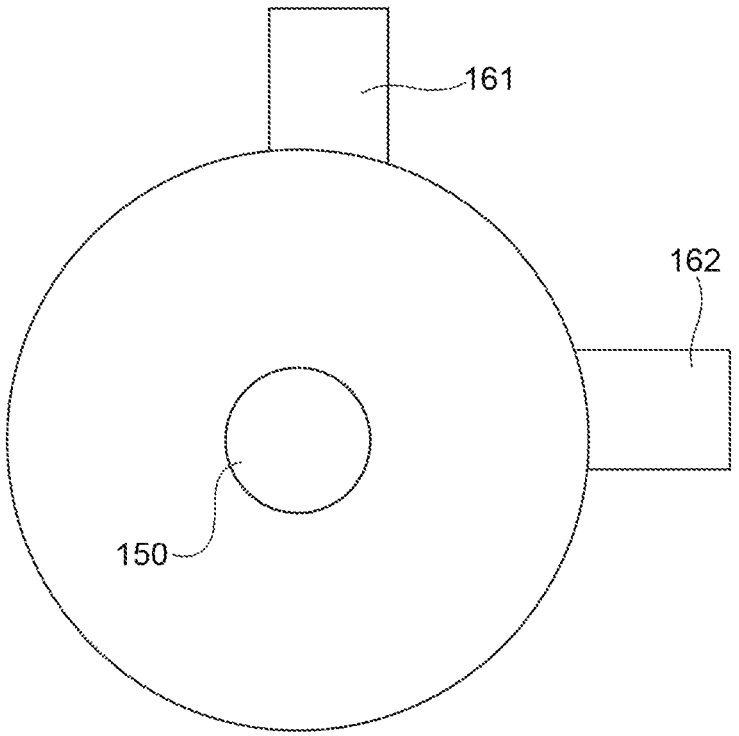

FIGS. 1-3 show a microwave circular polarizer (denoted as a whole by 1) according to a preferred embodiment of the present invention. In particular, FIG. 1 is a perspective view of the microwave circular polarizer 1, while FIGS. 2 and 3 are, respectively, bottom and top views thereof.

Said microwave circular polarizer 1 is designed to be used in RF chains of microwave antenna systems, and includes a first portion 11, a second portion 12 and a third portion 13 connected in cascade, wherein:

- the first portion 11 includes a first outer conductor (in particular, a first outer microwave conductor) 110, which is cylindrically shaped and internally hollow;

the second portion 12 includes a second outer conductor (in particular, a second outer microwave conductor) 120, which is cylindrically shaped, internally hollow, and is connected to the first outer conductor 110 so as to form therewith a first step discontinuity 141; and the third portion 13 includes a third outer conductor (in particular, a third outer microwave conductor) 130, which is cylindrically shaped, internally hollow, and is connected to the second outer conductor 120 so as to form therewith a second step discontinuity 142.

A first longitudinal axis of the (cylindrically-shaped) first outer conductor 110, a second longitudinal axis of the (cylindrically-shaped) second outer conductor 120, and a third longitudinal axis of the (cylindrically-shaped) third outer conductor 130 do not coincide, in particular are parallel to one another.

The first outer conductor 110 has a first width perpendicularly to the first longitudinal axis, and a first length parallelly to said first longitudinal axis.

The second outer conductor 120 has:

perpendicularly to the second longitudinal axis, a first width larger than the first width; and, parallelly to said second longitudinal axis, a second length smaller than the first length.

The third outer conductor 130 has:

perpendicularly to the third longitudinal axis, a third width larger than the first and second widths; and parallelly third longitudinal axis, a third length that is larger than the second length and that may be smaller than, equal to, or larger than, the first length.

Preferably, said third length is smaller than said first length so as to minimize the overall longitudinal size of the microwave circular polarizer 1.

Moreover, the microwave circular polarizer 1 further includes an inner conductor (in particular, an inner microwave conductor) 150, which is cylindrically shaped, extends inside the first, second and third outer conductors 110, 120, 130, and is spaced apart from said first, second and third outer conductors 110, 120, 130, thereby resulting in an internal cavity being present between said inner conductor 150 and said first, second and third outer conductors 110, 120, 130.

A fourth longitudinal axis of the (cylindrically-shaped) inner conductor 150 coincides with the third longitudinal axis, and hence is parallel to the first and second longitudinal axes. In other words, as for relative arrangement of the inner conductor 150 and, respectively, the first, second and third outer conductor 110, 120, 130, the first and second portions 11, 12 have an axially asymmetrical configuration, while the third portion 13 has an axially symmetrical configuration (i.e., a classical coaxial configuration).

Additionally, the microwave circular polarizer 1 further includes a first rectangular waveguide port 161 and a second rectangular waveguide port 162, that are designed to be connected, each, to a respective rectangular waveguide (not shown in FIGS. 1-3) for receiving therefrom input linearly polarized microwave signals and/or for providing thereto output linearly polarized microwave signals.

The first and second rectangular waveguide ports 161, 162 are:

coupled to the first outer conductor 110, specifically to an external wall thereof (i.e., externally to the internal cavity);

oriented orthogonally to the first longitudinal axis of the first outer conductor 110;

positioned relative to one another so as to form a 90-degree angle with respect to said first longitudinal axis; and in signal communication with the internal cavity through, respectively, a first rectangular aperture and a second rectangular aperture formed through the first outer conductor 110.

The first and second rectangular waveguide ports 161, 162 are oriented so as to have larger size parallelly to the first longitudinal axis. In particular, said first and second rectangular waveguide ports 161, 162 have, parallelly to said first longitudinal axis, a fourth length equal to the first length (i.e., they longitudinally extend along the whole first outer connector 110 and, hence, the whole first portion 11).

Moreover, the microwave circular polarizer 1 includes also a first septum 171 and a second septum 172.

In particular, the first septum 171 is arranged on an internal wall of the first outer conductor 110 (i.e., inside the internal cavity) and is positioned, relative to the first and second rectangular waveguide ports 161, 162, so as to form, with each of said first and second rectangular waveguide ports 161, 162, a respective 45-degree angle with respect to the first longitudinal axis.

Said first septum 171 has substantially a rectangular parallelepiped shape with larger size parallelly to said first longitudinal axis.

Conveniently, said first septum 171 has, parallelly to said first longitudinal axis, a fifth length equal to the first length (i.e., it longitudinally extends inside the whole first portion 11).

The second septum 172 is arranged on an external wall of the inner conductor 150 (i.e., inside the internal cavity) and is positioned, relative to the first and second rectangular waveguide ports 161, 162, so as to form, with each of said first and second rectangular waveguide ports 161, 162, a respective 135-degree angle with respect to the first longitudinal axis.

Said second septum 172 has substantially a rectangular parallelepiped shape with larger size parallelly to said first longitudinal axis.

conveniently, said second septum 172 has, parallelly to said first longitudinal axis, a sixth length equal to the sum of the first and second lengths (i.e., it longitudinally extends inside the whole first and second portions 11, 12).

Conveniently, said first and second septa 171, 172 are thin metal septa.

In use, circularly polarized microwave signals propagating inside the internal cavity of the microwave circular polarizer 1 (in particular, from the third portion 13 to the first portion 11) result in linearly polarized microwave signals at the first and second rectangular waveguide ports 161, 162, and vice versa.

In particular, circularly polarized microwave signals with RHCP propagating inside the internal cavity of the microwave circular polarizer 1 result in linearly polarized microwave signals at one of the two rectangular waveguide ports 161, 162 and vice versa, while circularly polarized microwave signals with LHCP propagating inside the internal cavity of the microwave circular polarizer 1 result in linearly polarized microwave signals at the other of the two rectangular waveguide ports 161, 162 and vice versa.

In detail, the septa 171, 172, along with their relative arrangement with respect to the rectangular waveguide ports 161, 162 and the peculiar structure of the first, second and third portions 11, 12, 13, allow to obtain in-quadrature excitation, in the internal cavity of the microwave circular polarizer 1, of the modes $TE_{11}^{0}$ and $TE_{11}^{90}$ and to suppress the undesired Transverse electromagnetic (TEM) fundamental modes.

To put the foregoing in a different way, the proposed device configuration stems from a 5-port turnstile junction in coaxial waveguide, wherein four rectangular waveguide ports are typically employed, which are orthogonal to the body of a coaxial waveguide, which represents the $5^{th}$ physical port supporting two electrical ports with the field oriented orthogonally (specifically, the $TE_{11}^{0}$ and $TE_{11}^{90}$ modes). Generally, the feeding of an opposite pair of rectangular ports permits to excite the $TE_{11}^{0}$ or $T_{11}^{90}$ mode and, in order to obtain the desired circular polarization, the two pairs of rectangular ports must be in quadrature. This typically requires a polarization network connected to the turnstile junction.

On the contrary, the microwave circular polarizer 1 includes the first and second portions 11, 12 which have an axially asymmetrical configuration, and the third portion 13 that is axially symmetrical, wherein the first portion 11 with its axially asymmetrical configuration along with the use of the aforesaid rectangular waveguide ports 161, 162 and septa 171, 172 allow to excite the two modes $TE_{11}^{0}$ and $TE_{11}^{90}$ inside the internal cavity, without need for any polarization network.

Moreover, the two step discontinuities 141, 142 allow to improve matching and isolation at the rectangular waveguide ports 161, 162.

Figure 4:
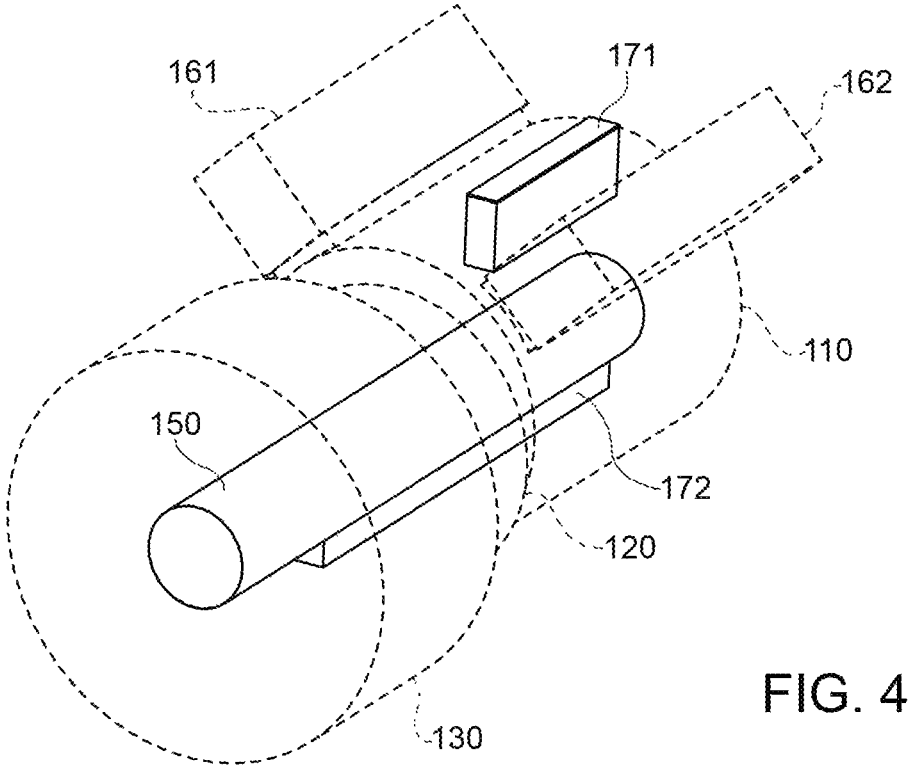
FIGS. 4 and 5 show two alternative, preferred embodiments of an inner conductor of the microwave circular polarizer of FIGS. 1-3.
Figure 5:
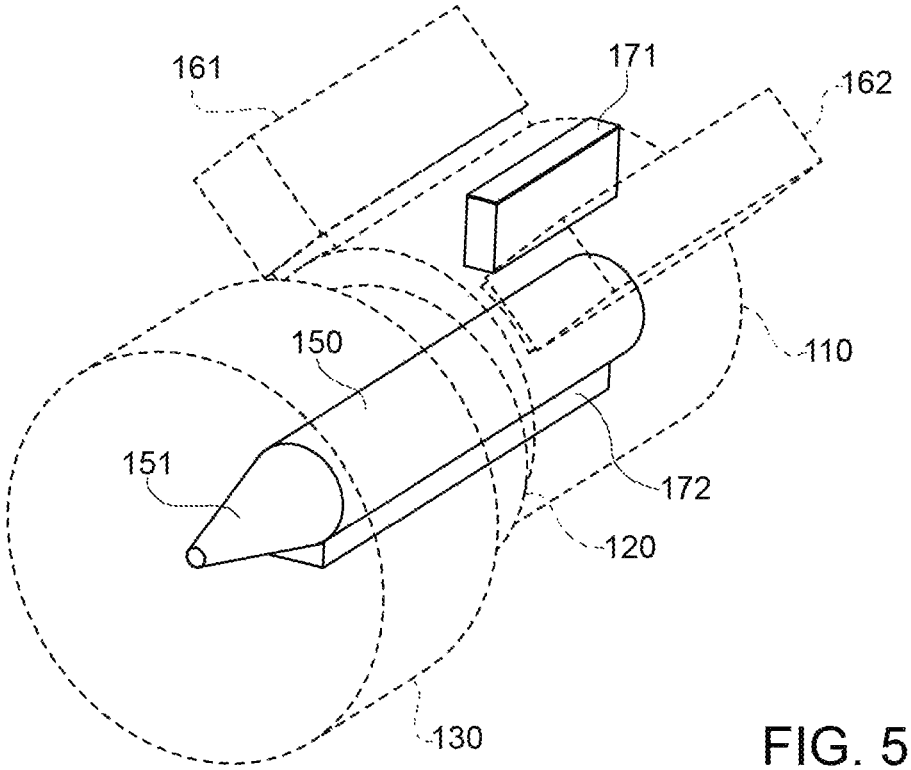

FIGS. 4 and 5 show two alternative, preferred embodiments for the inner conductor 150. In particular, FIGS. 4 and 5 are perspective view of the microwave circular polarizer 1, wherein the first, second and third outer conductors 110, 120, 130 and the first and second rectangular waveguide ports 161, 162 are transparent for the sake of clarity (in particular, in order to permit to see the inner conductor 150 and the first and second septa 171, 172).

In detail, as shown in FIG. 4, the inner conductor 150 can conveniently extend longitudinally inside the whole first portion 11, the whole second portion 12, and also the whole third portion 13, thereby implementing the circular polarization port as a coaxial port.

Alternatively, as shown in FIG. 5, the inner conductor 150 can conveniently extend longitudinally inside the whole first and second portions 11, 12, ending with a tapered end (such as a cone-shaped end) 151 inside the third portion 13 (in particular, inside the third outer conductor 130), thereby passing from coaxial to circular waveguide and, hence, implementing the circular polarization port as a circular port.

Due to single geometry layout necessary to realize the circular polarization, the microwave circular polarizer 1 has, preferably, an overall length equal to approximately $1\lambda$ (where $\lambda$ denotes the wavelength of the microwave signals which said microwave circular polarizer 1 is designed for).

Conveniently, the inner conductor 150 can be internally hollow and a transmission line (such as a circular/square/rectangular coaxial waveguide, or a coaxial cable, or a circular/square/rectangular waveguide) can be provided (i.e., arranged or formed) in said inner conductor 150, thereby permitting the propagation of further microwave signals at higher frequency and, hence, allowing double frequency band use. Such a configuration can be advantageously exploited, for example, for the integrated antenna system for use on board satellites and space platforms (in particular, low-Earth-orbit (LEO) satellites) according to Applicant's International application PCT/EP2016/081811, wherein said integrated antenna system includes two antennas arranged on top of one another, one for data downlink (DDL) and the other for Telemetry, Tracking and Command (TT&C).

Figure 6:
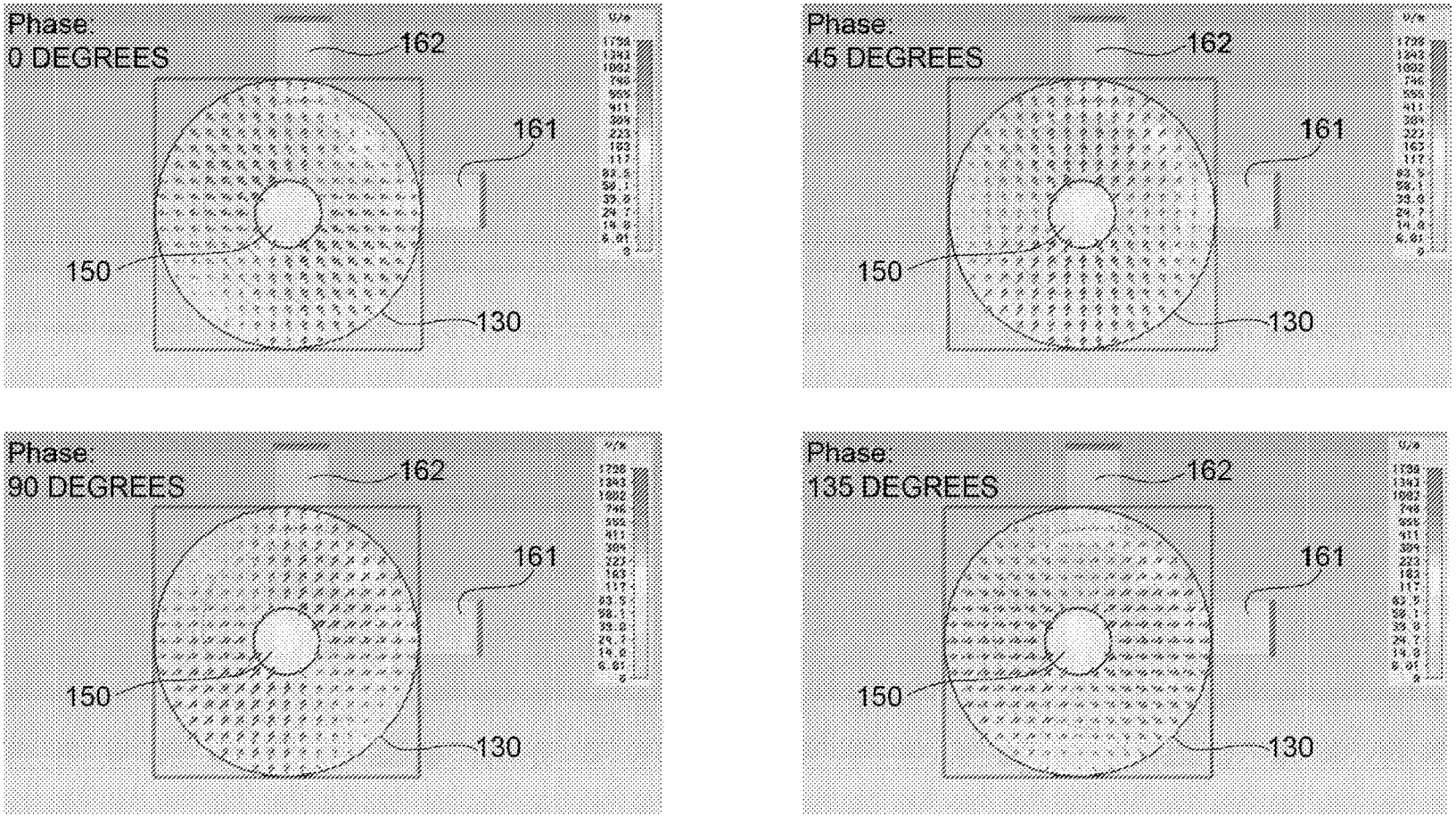
FIGS. 6 and 7 show field maps at a coaxial port of the microwave circular polarizer of FIGS. 1-3.
Figure 7:
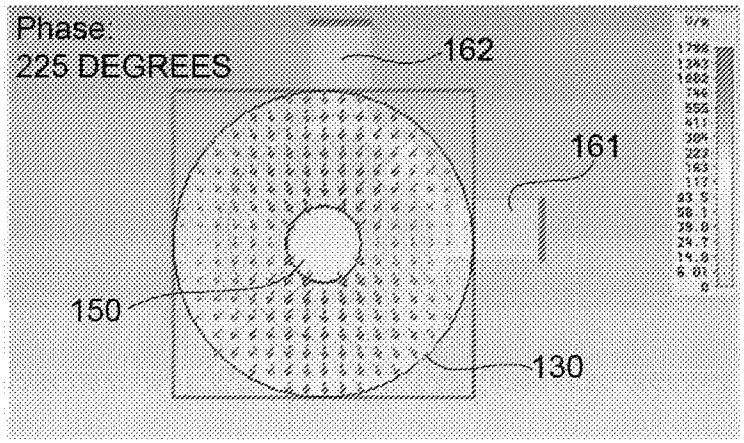
Figure 7:
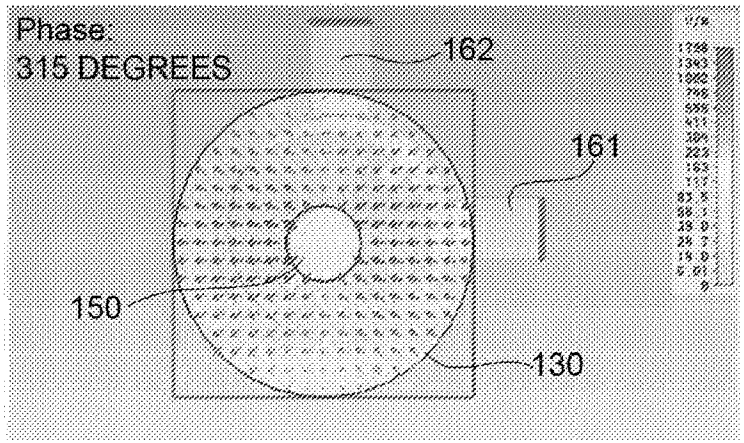
Figure 7:
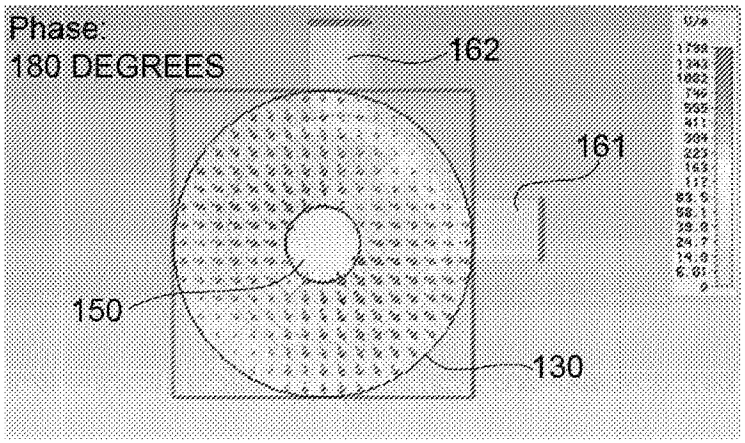
Figure 7:
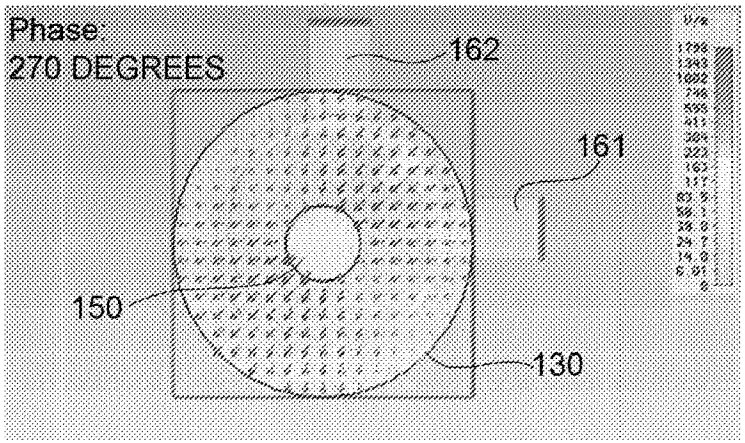

FIGS. 6 and 7 show field maps at the coaxial port of the microwave circular polarizer 1 for different phases. The rotation of the field, that indicates the realization of the circular polarization, is immediately clear from FIGS. 6 and 7 for those skilled in the art.

Figure 8:
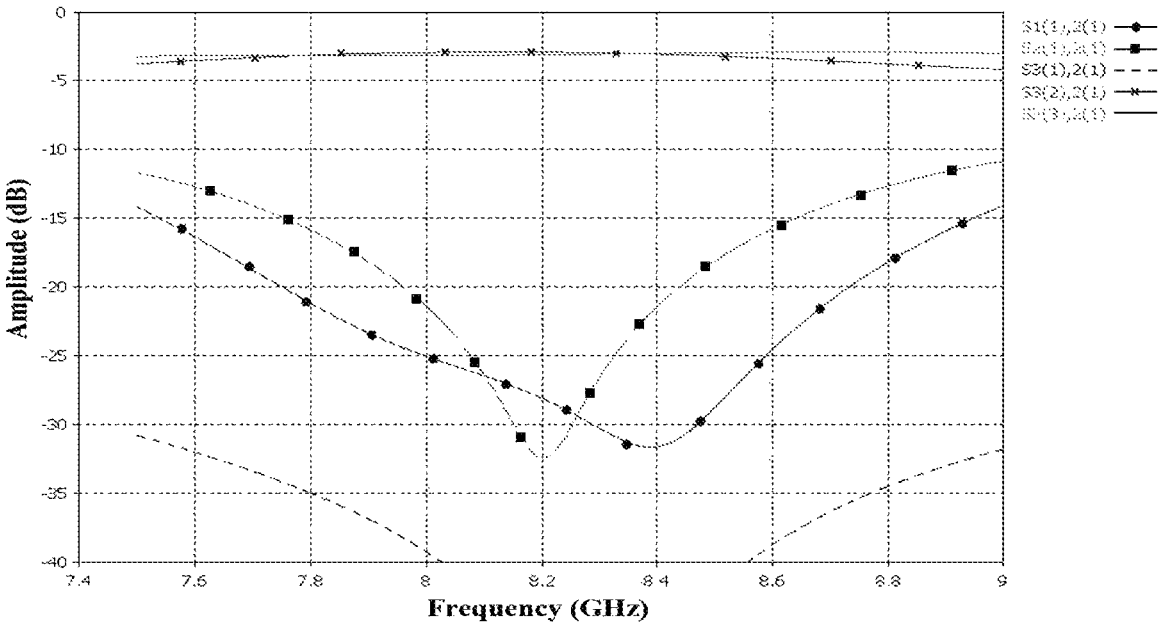
FIGS. 8 and 9 show electrical performance in X band of the microwave circular polarizer of FIGS. 1-3.

Moreover, FIG. 8 shows S-parameters for the microwave circular polarizer 1 in X band. In particular, FIG. 8 shows: scattering parameter at the second rectangular waveguide port 162, port-to-port isolation between the first and second rectangular waveguide ports 161, 162, S-parameter between the undesired mode TEM and the mode at the first rectangular waveguide port 161, excitation amplitudes of the desired modes $TE_{11}^{0}$ and $TE_{11}^{90}$ at the coaxial port.

Figure 9:
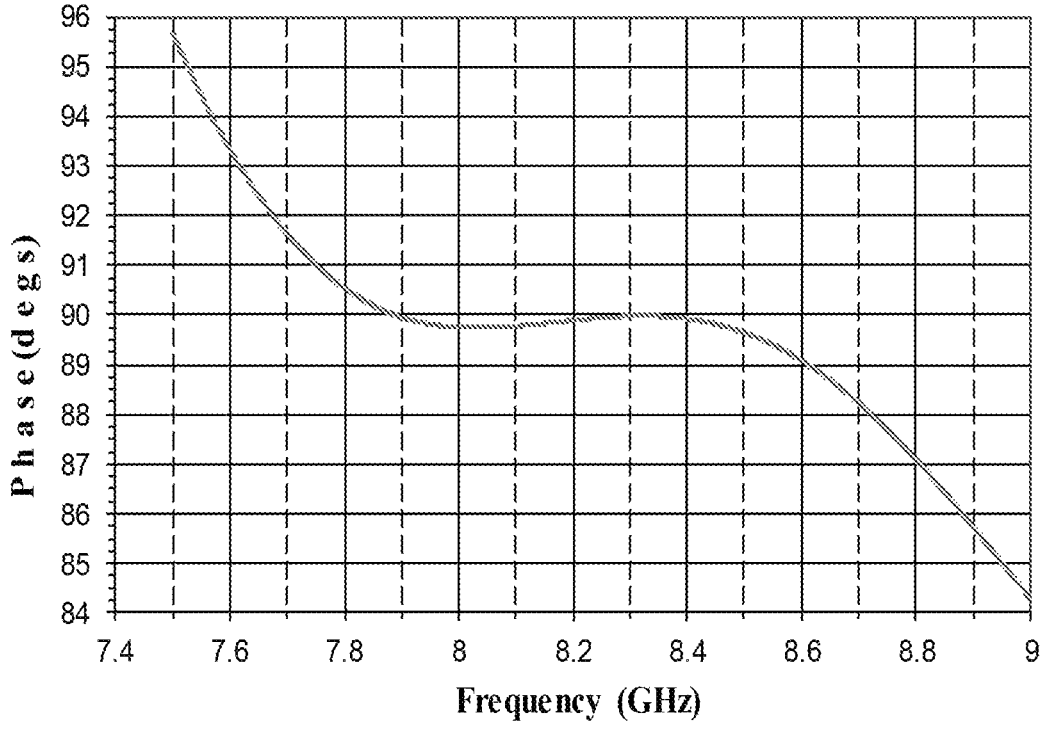

Additionally, FIG. 9 shows differential phase between modes $TE_{11}^{0}$ and $TE_{11}^{90}$ at the coaxial port.

In view of the foregoing, the present invention concerns an asymmetrical coaxial polarizer with high compactness that is capable to generate double circular polarization from two independent orthogonal rectangular waveguides, one for LHCP and other for RHCP.

An important advantage of the present invention is the reduced longitudinal size with respect to conventional microwave circular polarizers. Such a reduced longitudinal size is particularly useful for lower frequencies.

Another advantage is represented by the rectangular waveguide ports 161, 162 orthogonal to the axis of the microwave circular polarizer 1. This fact simplifies the layout of the device and its integration with other components.

Moreover, the present invention provides a high degree of flexibility with respect to waveguide output section, which can be coaxial or circular.

Thence, the present invention provides an efficient solution to the technical problems related to:

axial envelope compactness;

circular polarizer use in either coaxial or circular configuration;

circular polarizer use for double frequency bands.

In conclusion, it is clear that numerous modifications and variants can be made to the present invention, all falling within the scope of the invention, as defined in the appended claims.

The invention claimed is:

1. Microwave circular polarizer (1) including:

a first outer conductor (110), which is cylindrically shaped and internally hollow;

a second outer conductor (120), which is cylindrically shaped, internally hollow, and is connected to the first outer conductor (110) forming a first step discontinuity (141) therewith; and a third outer conductor (130), which is cylindrically shaped, internally hollow, and is connected to the second outer conductor (120) forming a second step discontinuity (142) therewith;

wherein a first longitudinal axis of the first outer conductor (110), a second longitudinal axis of the second outer conductor (120), and a third longitudinal axis of the third outer conductor (130) are parallel to one another;

said microwave circular polarizer (1) further including an inner conductor (150), which is cylindrically shaped, extends inside the first, second and third outer conductors (110, 120, 130), and is spaced apart from said first, second and third outer conductors (110, 120, 130), thereby resulting in an internal cavity being present between said inner conductor (150) and said first, second and third outer conductors (110, 120, 130);

wherein a fourth longitudinal axis of the inner conductor (150) coincides with the third longitudinal axis and is parallel to the first and second longitudinal axes, thereby resulting in an axially asymmetrical configuration of the first and second outer conductors (110, 120) with respect to the inner conductor (150), and an axially symmetrical configuration of the third outer conductor (130) with respect to said inner conductor (150);

said microwave circular polarizer (1) further including a first rectangular waveguide port (161) and a second rectangular waveguide port (162), that are:

coupled to the first outer conductor (110) externally to the internal cavity;

oriented orthogonally to the first longitudinal axis;

positioned relative to one another so as to form a 90-degree angle with respect to said first longitudinal axis; and in signal communication with the internal cavity through, respectively, a first rectangular aperture and a second rectangular aperture formed through the first outer conductor (110);

said microwave circular polarizer (1) further including a first septum (171) and a second septum (172);

wherein said first septum (171) is arranged on the first outer conductor (110) inside the internal cavity and is positioned, relative to the first and second rectangular waveguide ports (161, 162), so as to form, with each of said first and second rectangular waveguide ports (161, 162), a respective 45-degree angle with respect to the first longitudinal axis;

and wherein the second septum (172) is arranged on the inner conductor (150) inside the internal cavity and is positioned, relative to the first and second rectangular waveguide ports (161, 162), so as to form, with each of said first and second rectangular waveguide ports (161, 162), a respective 135-degree angle with respect to the first longitudinal axis.

2. The microwave circular polarizer of claim 1, wherein the inner conductor (150) extends longitudinally inside the whole first outer conductor (110), the whole second outer conductor (120), and the whole third outer conductor (130).

3. The microwave circular polarizer of claim 1, wherein the inner conductor (150) extends longitudinally inside the whole first outer conductor (110) and the whole second outer conductor (120), and ends with a tapered end (151) inside the third outer conductor (130).

4. The microwave circular polarizer of claim 3, wherein the tapered end (151) is cone-shaped.

5. The microwave circular polarizer according to claim 1, wherein the inner conductor (150) is internally hollow, and wherein a transmission line is provided in said inner conductor (150).

6. The microwave circular polarizer according to claim 1, wherein the first outer conductor (110) has a first width perpendicularly to the first longitudinal axis, and a first length parallelly to said first longitudinal axis;

wherein the second outer conductor (120) has:

perpendicularly to the second longitudinal axis, a first width larger than the first width; and, parallelly to said second longitudinal axis, a second length smaller than the first length;

and wherein the third outer conductor (130) has, perpendicularly to the third longitudinal axis, a third width larger than the first and second widths.

7. The microwave circular polarizer according to claim 1, wherein the first and second rectangular waveguide ports (161, 162) have larger size parallelly to the first longitudinal axis.

8. The microwave circular polarizer according to claim 1, wherein the first and second rectangular waveguide ports (161, 162) extend, parallelly to the first longitudinal axis, along the whole first outer connector (110).

9. The microwave circular polarizer according to claim 1, wherein the first and second septa (171, 172) have a rectangular parallelepiped shape with larger size parallelly to the first longitudinal axis.

10. The microwave circular polarizer according to claim 1, wherein the first septum (171) extends, parallelly to the first longitudinal axis, inside the whole first outer connector (110); and wherein the second septum (172) extends, parallelly to the first longitudinal axis, inside the whole first outer connector (110) and the whole second outer connector (120).

11. Microwave antenna system including the microwave circular polarizer (1) as claimed in claim 1.

* * * * *